United States Patent [19]

Tschanz

[11] Patent Number: 4,976,548

[45] Date of Patent: Dec. 11, 1990

[54] WATCH ADAPTABLE TO BEING WORN ON THE WRIST AND AROUND THE NECK

[76] Inventor: Pierre Tschanz, Neuwis 25, 8700 Küsnacht, Switzerland

[21] Appl. No.: 611,035

[22] PCT Filed: Sep. 12, 1983

[86] PCT No.: PCT/CH83/00104

§ 371 Date: May 11, 1984

§ 102(e) Date: May 11, 1984

[87] PCT Pub. No.: WO84/01229

PCT Pub. Date: Mar. 29, 1984

[30] Foreign Application Priority Data

Sep. 15, 1982 [CH] Switzerland ..... 5471/82

[51] Int. Cl.[5] ..... G04B 37/00

[52] U.S. Cl. ..... 368/277; 368/282; 224/164; 224/172

[58] Field of Search ..... 368/282, 281, 277, 276, 368/285; 224/164, 169, 170, 172, 178

[56] References Cited

U.S. PATENT DOCUMENTS

| | | | |
|---|---|---|---|
| 1,139,107 | 5/1915 | Depollier | 368/277 |
| 1,382,256 | 6/1921 | Tomchin | 368/277 |
| 1,516,599 | 11/1924 | Gsell | 368/277 |
| 2,099,515 | 11/1937 | Grey | 368/277 |

FOREIGN PATENT DOCUMENTS

| | | | |
|---|---|---|---|
| 295349 | 12/1915 | Fed. Rep. of Germany | 368/277 |
| 1758993 | 11/1957 | Fed. Rep. of Germany . | |
| 2658419 | 12/1977 | Fed. Rep. of Germany . | |
| 197915 | 5/1937 | Switzerland | 368/282 |
| 346177 | 6/1960 | Switzerland | 368/282 |

*Primary Examiner*—Bernard Roskoski

*Attorney, Agent, or Firm*—Cushman, Darby & Cushman

[57] ABSTRACT

The case (1) of the watch carries, along its periphery (5), hooking members in the form of rings (6a, 6a', 6b, 6b', 6c, 6c'), these rings being disposed radially relative to the center (7) of the dial (2) and hence of the watch. A chain (8) is fixed by loops (9, 10) at its ends to two (6c, 6c') of these rings and passes through the other rings (6a, 6a', 6b, 6b'), passing several of times around the wearer's wrist. After the loops (9, 10) have been detached from their respective rings, the chain (8) can be passed in a different manner around the case, so that the watch can be hung around the neck. In order to make this change, the chain is equipped with a flat link (13) which can pass through radial slots provided in the periphery of the rings.

3 Claims, 1 Drawing Sheet

WATCH ADAPTABLE TO BEING WORN ON THE WRIST AND AROUND THE NECK

The invention relates to a watch which can be worn in a variety of ways. The watch comprises: a case for housing the movement, the dial and the hands; a chain; and a series of rings provided on the case and adapted to receive the chain in such a manner that it is possible to wear the watch either on the wrist or with the chain around the neck.

Watches which can be worn in a variety of ways are already known, that is to say watches which can selectively be worn on the wrist with the aid of a bracelet or suspended by means of a chain or ribbon passing around the neck. However, in order to change the manner in which these watches are worn, one of the devices for wearing the watch, for example the bracelet, must be removed, and the chain attached, or vice versa, which is not only complicated but also makes is necessary for the wearer to carry on his or her person the device not in use at the time in question.

The invention seeks to obviate this shortcoming by providing a watch which with the aid of one and the same device can be worn according to choice.

Details and features of the invention will became apparent from the description given below of a preferred form of construction of the watch forming the subject of the invention, with reference to the accompanying drawing, in which.

The watch has a case 1 housing in the usual manner a movement (not shown), a dial 2 with hands 3 and a glass 4 for protecting the dial 2 and hands 3. The case may have various shapes; it is not confined to the circular shape illustrated.

Figure 1:
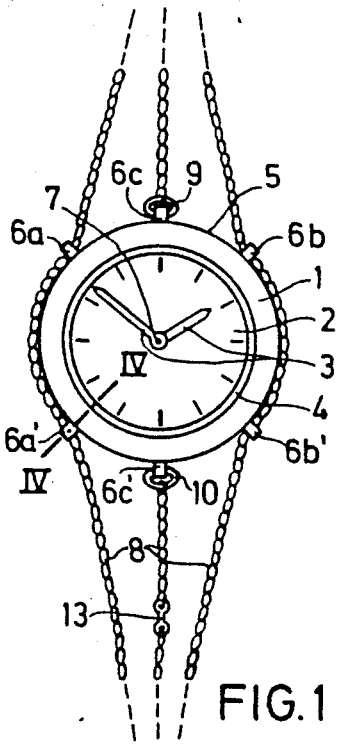
FIG. 1 is a front view of the watch.
Figure 2:
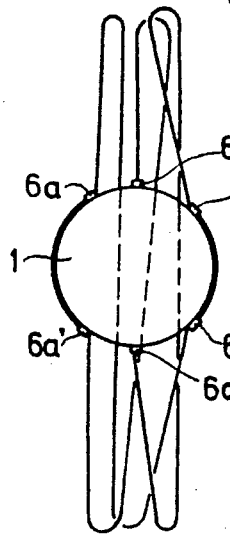
FIG. 2 is a diagrammatic illustration of the path followed by the chain relative to the watch when the latter is worn on the wrist.

On its periphery 5 the case 1 is provided with a number of hooking members. In the embodiment shown, six members *6a*, *6a'*, *6b*, *6b'*, *6c*, *6c'* are provided, the members *6a* being situated on the left-hand side, the members *6b* on the right-hand side, and the members *6c* at the top and bottom of the case when the latter is in the suspended position. As can best be seen in FIG. 4, these members are rings joined by part of their periphery to the periphery 5 of the case 1. As can be seen in FIGS. 1 and 2, each ring 6 is situated in a plane which is perpendicular to the plane of the drawing and which passes through the center of the dial 2 and consequently through the axes of rotation the hands 3. For reasons of symmetry, an arrangement is preferred in which two members are always diametrically opposite, so that these members are situated in the same plane passing through the center 7.

Figure 3:
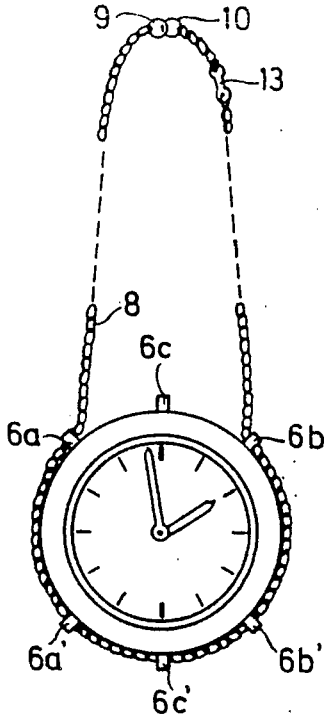
FIG. 3 is a similar view to FIG. 1, but showing the other manner of wearing the watch.

Either all or some of the members 6 serve to attach the case 1 to a chain 8, and this can be done in two different ways, as will be explained in detail. This chain 8 passes through a number of rings 6, this number depending on the method of attachment, as can be seen from comparison of FIGS. 1 and 3. In order to wear the watch on the wrist, in accordance with FIG. 1, the chain is attached, by means of a first loop 9 at its end, to the top ring *6c*. The chain a first time around the wrist, then through the left-hand members *6a'*, *6a*, a second time around the wrist, through the right-hand members *6b'*, *6b*, and, after a third turn around the wrist, ends at the bottom ring *6c'*, where it is attached with the aid of a second loop 10 at the other end. These loops 9, 10 may be equipped with safety devices, known per se and not illustrated, in order to prevent the chain 8 from being accidentally separated from the case 1. For the purpose of wearing the watch in the manner illustrated in FIG 3, the chain 8 is passed through the left-hand rings *6a*, *6a'*, the bottom ring *6c'* and the right-hand rings *6b'*, *6b*. The top ring *6c* is not used. The two loops 9, 10, which have been detached from their respective rings, are connected together as illustrated in FIG. 3. The watch is then ready to be worn with the chain placed around the wearer's neck.

It is also possible to introduce the chain through the top ring *6c* and not to use the bottom ring *6c'*. The watch will thus be suspended in the opposite manner, that is to say, on the dial the numeral 12 will be at the bottom and the numeral 6 at the top. The advantage for the wearer is that it will only be necessary to lift the watch in order to see the time, without it being necessary to turn it upside down as in the case of the suspension illustrated. It can be seen from this that it is possible to wear the watch in several ways.

Figure 4:
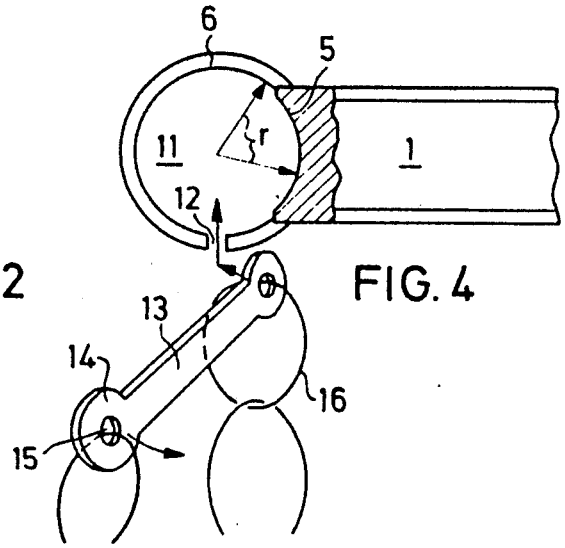
FIG. 4 is a partial section on the line IV—IV in FIG. 1.

FIG. 4 shows the preferred shape of the rings 6, and also their fastening to the case 1. Each ring has a circular opening 11 having a radius r. The periphery 5 of the case 1, viewed in section, is concave; the radius of this curvature is preferably identical with the said inside radius, so that the circular shape of the opening 11 is completed by the curvature. However, this is not essential; the radius r of the opening 11 can be so selected, or the shape may be so modified, that the rings 6 no longer exceed the thickness of the case 1.

In view of the fact that the loops 9,10 have a diameter which prevents them from passing through the openings 11 of the rings 6, means are provided for introducing the chain 8 into the rings 6, or for removing it from them, when the manner in which the watch is worn is changed. For this purpose each ring is provided with a radial slot 12 in its periphery. The chain 8 in turn is provided with a special link 13. This link is essentially a thin plate having rounded ends 14 which are provided with holes 15 for attaching the adjacent links 16. The thickness of the plate is less than the width of the slot 12. It is thus possible to introduce this ling into each ring after turning it into position as indicated by the arrows, and consequently to pass the entire chain through the rings 6 without utilizing complicated means, such as special or detachable loops, or rings which can be opened and closed after insertion of the chain.

I claim:

1. A watch adaptable to be worn on the wrist and around the neck, comprising:

a case housing a watch movement, a dial and hands;

a plurality of rings disposed symmetrically around the periphery of the case; and a chain or selectively retained by the rings, said chain being retained by less than said plurality of rings to thereby be effectively lengthened for wear around the neck or being retained by said plurality of rings to thereby be effectively shortened for wear around the wrist, at least some of said rings being provided with a slot through which said chain may pass so as to be selectively retained by the rings, the chain including at least one link having a thickness less than the width of the slot so as to allow said at least one link to pass therethrough.

2. A watch according to claim 1, wherein each ring is fixed to the case in such a manner that it is situated in a plane that is radially related to the dial, each plane passing through the center of the dial.

3. A watch according to claim 1, wherein the chain has first and second ends that are attached to two of the rings.

* * * * *